United States Patent [19]

Hanlon, Jr.

[11] 4,098,533

[45] Jul. 4, 1978

[54] ARTICLE MOVING ATTACHMENT

[76] Inventor: John P. Hanlon, Jr., Scott Rd., Concordville, Pa. 19331

[21] Appl. No.: 733,912

[22] Filed: Oct. 19, 1976

[51] Int. Cl.[2] ..... B66C 1/48

[52] U.S. Cl. ..... 294/116

[58] Field of Search ..... 294/16, 28, 86 R, 95, 294/104, 106, 116, 118; 24/248 C, 248E; 214/620, 621; 280/24

[56] References Cited

U.S. PATENT DOCUMENTS

| | | | |
|---|---|---|---|
| 2,335,214 | 11/1943 | McCartney | 294/116 |
| 2,367,766 | 1/1945 | Foss | 294/116 |
| 2,383,078 | 8/1945 | Pringle | 294/116 |
| 2,989,337 | 6/1961 | Pispisa | 294/116 X |
| 3,318,630 | 5/1967 | Bryant | 294/116 X |
| 3,807,786 | 4/1974 | Alegria | 294/116 X |

FOREIGN PATENT DOCUMENTS

| | | | |
|---|---|---|---|
| 4,440 | 1/1892 | Fed. Rep. of Germany | 24/248 C |
| 903,122 | 8/1962 | United Kingdom | 294/116 |

*Primary Examiner*—Johnny D. Cherry

*Attorney, Agent, or Firm*—E. Barron Batchelder; Daniel W. Sixbey; Charles M. Leedom, Jr.

[57] ABSTRACT

An article moving attachment, and the like, including a grapple member adapted for engaging, for example, base runners of skids or pallets, or other articles, and being selectively connectable to power actuated means such as a line, through which a skid or an article can be moved from an initial position of perhaps difficult access to a subsequent position providing ready access to facilitate removal from a carrier, or unloading by a lift fork truck, and the like. The attachment includes mechanism coactable with the grapple member whereby a grappling force is directly proportional to the weight of an article being moved.

8 Claims, 7 Drawing Figures

18
12
16
14
22
24
26
20
10

66
76
40
32
68
72
38
64
24
78
34
68
74

40
44
28
32
68
80
44
42
30
34
66

ARTICLE MOVING ATTACHMENT

BACKGROUND OF THE INVENTION

The present invention will be described and illustrated as applied to a pallet or skid adapted to be moved by a fork lift truck from one position to a second position and which can be of substantially different heights or levels, thereby precluding ready placement and use of the fork lift truck, or wherein the skid or pallet or other article is in an area of difficult access and especially for devices such as fork lift trucks. Manifestly, the teachings of the invention and the mechanism are applicable for additional uses generally in the movement of an article or the like from one position to another.

Many manufacturing plants, etc., where deliveries are made by motor freight and rail car, do not have docks or platforms, thus making difficult or impractical free access to the trailer or freight car by a fork lift truck or other similar device. Frequently, this results in a situation where a deck or floor of the trailer, truck or freight car is, or may be, several feet above the ground or other working area on which the fork truck is operating. The present invention is operable to eliminate or decrease difficulties involved in, for example, a tractor-trailer delivery situation wherein the aforesaid difficulties can be encountered when having to unload skids or pallets of cargo, freight, etc.

Usually cargo is unloaded through a side or rear door and frequently this cargo is not within reach of the forks of a fork truck, such as being positioned at the door or tailgate, and therefore, the cargo must either be unloaded by hand or somehow moved to the doorway or tailgate so that it can be reached by the truck. This is usually accomplished by one or more people pushing a skidded load and sliding it along a floor. This brute approach works to a degree, depending upon the weight of the loaded skid, friction, etc., but frequently is unsafe to the operator or articles in, for example, causing hernias, crushed hands, damaged or lost loads, etc. In some instances this positioning of the skidded load near the door is done by lifting a hand truck up to the floor bed with a fork truck, provided there is space to accomplish this, and an area within the truck permits one to maneuver the hand truck. While this does reduce physical strain when unloading, there have been bodily injuries and cargo damage because of a hand truck becoming uncontrollable and cargo has been dumped, hand truck and all, right out the door.

Another, and a more common method, is to lash a rope or chain around the leg of a skid and then secure the other end to a fork truck which is then used to drag the load to the door where, after unsecuring the chain or rope, it can be picked up by the fork truck. It is not uncommon to have loads up to, for example, 3,000 pounds on a skid and this might cause considerable difficulties in attempting to unite a knot or disconnect a line after pulling such a load. Difficulties are also encountered in attaching or unattaching such a chain or rope. The problem is compounded where there are conditions of dense cargo packing or stacking and the cargo might even be loaded sidewall to sidewall, thereby precluding easy access. In such circumstances, it is not uncommon to utilize a large pry bar to inch a skid sufficiently to obtain access.

The present invention is devised to overcome the foregoing difficulties and to greatly facilitate movement, unloading, etc. of such loads either on skids or as separate articles. Manifestly, the present device substantially decreases the possibilities or likelihood of physical injury or damage to personnel or articles.

It is accordingly a primary object of the present invention to provide mechanism in the nature of an article moving attachment which overcomes the aforementioned drawbacks and greatly facilitates movement for unloading of merchandise or the like from difficult areas of accessibility. Manifestly, the mechanism can be utilized in different settings and for specifically different purposes.

The present invention will be more readily understood from the following detailed description of an embodiment thereof when taken together with the accompanying drawings in which.

Figure 1:
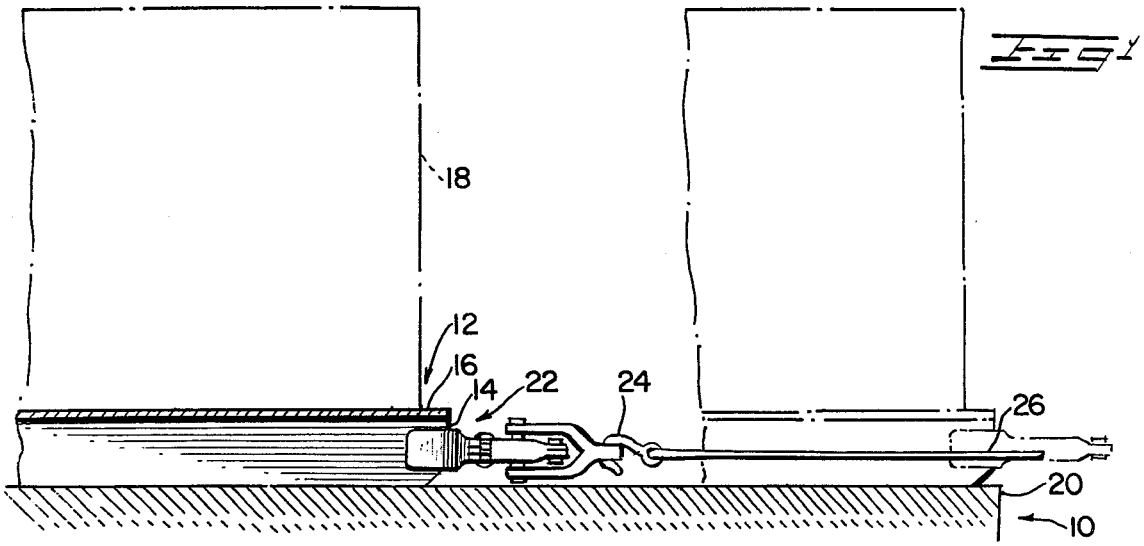
FIG. 1 is a fragmentary, partially schematic view showing the device of the present invention functionally oriented.

Referring now in greater detail to the drawings, in FIG. 1 a floor, deck or other surface generally designated 10 and which can consist of the floor of a trailer or freight car or the like, is shown as supporting a skid or pallet, generally designated 12. A base runner of a usual type for the pallet is shown at 14 and the floor of the skid is shown at 16 on which a load, shown in broken lines at 18 is supported. This load can be of any nature and frequently consists in heavy materials for which reason it is mounted on skids or pallets to facilitate its movement. Where a substantial weight is involved, movement of the skid from one position to another is many times difficult in the absence of use of a fork lift truck or the like, and frequently it is necessary to move such skids from one level to another at locations where different levels are involved, such as between a trailer body and a loading dock of different heights or in locations where loading docks are not provided. In like manner, frequently a skid is positioned in a conveyance device where it is difficult to obtain access for a fork lift truck and in many instances, the placement of a fork lift truck in the conveyance vehicle is difficult or impossible. In order to eliminate this and to be able to readily move a loaded skid to a position such as the edge 20 of the floor or deck, which could consititute a position at the edge of an access door or opening, where a fork lift truck could be operated to readily contact and load the skid for subsequent removal, the mechanism of the present invention is utilized. As shown in FIG. 1, the article moving attachment generally indicated at 22 is operably engaged with the end of base runner 14 and the opposite end is engaged by a hook 24 attached to the end of a rope or the like 26. The rope 26 is operatively connected with a mechanism, preferably power actuated, to apply a pulling force on the rope 26 and thus through the article moving attachment to the skid to move from a first position at the left-hand portion of the figure to a second position at the right-hand portion of the figure, to the edge 20 of the floor 10 and in which position a fork lift truck can readily engage with the skid for subsequent movement thereof.

Figure 2:
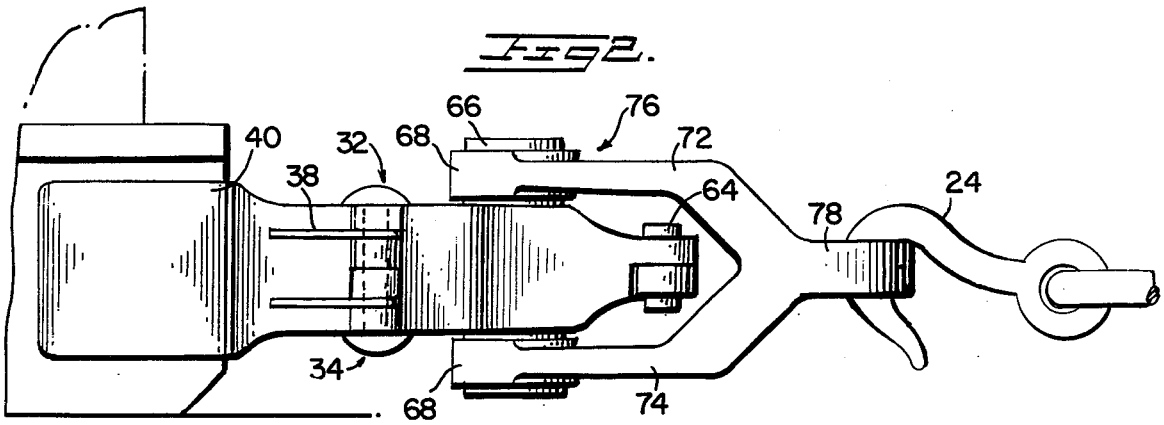
FIG. 2 is a fragmentary enlarged view of the attachment shown in FIG. 1.
Figure 5:
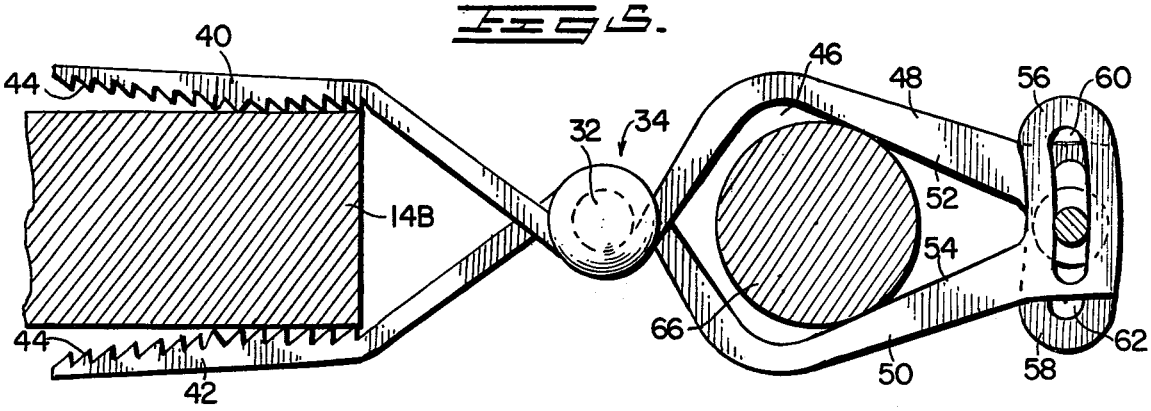
FIG. 5 is a view similar to FIG. 4, but showing the clamping jaws engaged with an item of greater width.
Figure 6:
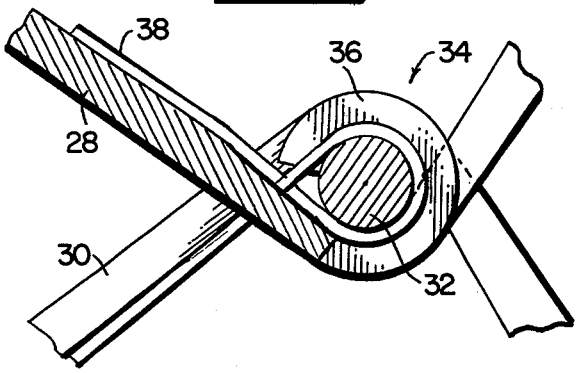
FIG. 6 is a fragmentary sectional view through a hinge coupling of the arms of the grappling member disclosing a spring adapted to maintain a grappling position of the grappling jaws.
Figure 7:
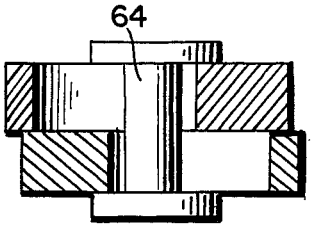
FIG. 7 is a sectional view taken on line 7—7 of FIG. 4 showing a detail of the mechanism.

The article moving attachment generally designated 22, referring to FIG. 2 and following, consists of two handles 28, 30 of a particular configuration and which are pivotably interengaged by means of a pivot pin 32 in the nature of a hinge pin. Obviously, a bolt or other connector could be used. This hinge pin is engaged through a hinge joint generally indicated at 34 formed by spaced and interengaged curvilinear tabs 36 in the bodies of the handles 28, 30, in the nature of a usual door hinge or the like, and shown in greater detail in FIG. 6. This hinge joint 34 interengages the handles 28 and 30 in a manner permitting pivoting of one with respect to the other. A spring 38 at the hinge joint 34 so engages the handles 28 and 30 as to apply a grappling force, as will be hereinafter described, by the grappling ends or jaws 40 and 42. It is noted that these grappling jaws have teeth 44 thereon, and which are arranged with their edges terminating in planes at opposite ends of the jaws angularly disposed with respect to one another. This disposition of the teeth and the direction of extension of the teeth provides for a biting engagement of these teeth with different thicknesses of, for example, base runners, as indicated at 14A in FIG. 4 and 14B in FIG. 5, the latter having a substantially greater width.

The ends of the handles opposite the grappling jaws, and on the other side of hinge 34, are so formed as to provide an open space 46 with the arms 48 and 50 being so bent or angularly configured as to in effect provide camming faces or surfaces 52 and 54. The ends 56 and 58 of these arms are extended and are slightly curvilinear and have formed respectively therein mating and coacting curvilinear shaped slots 60 and 62. A pin 64 extends through these mating slots. This pin in the ends of the handle members, riding in the slot, serves to maintain the position of the handles, one to the other, and additionally serves as safety means to prevent disengagement of an actuating pin 66 from the space 46.

Figure 3:
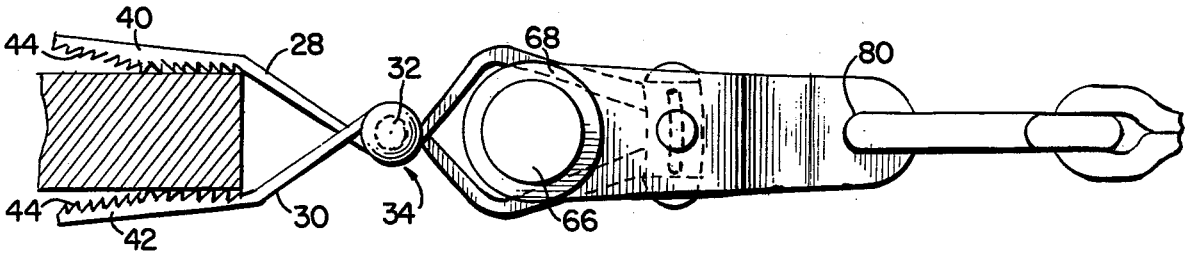
FIG. 3 is a plan view of the invention shown in FIG. 2.

The actuating pin 66, referring to FIGS. 2 and 3, and which extends transversely through the space 46 is mounted at its ends in bored ends 68 of legs 72 and 74 of a Y-shaped connector generally designated 76, the base leg 78 thereof being provided with a hole or opening 80 in which a hook 24 is engageable and which in turn is attached to the rope 26 so that when a force is applied, the skid or the like can be moved.

Figure 4:
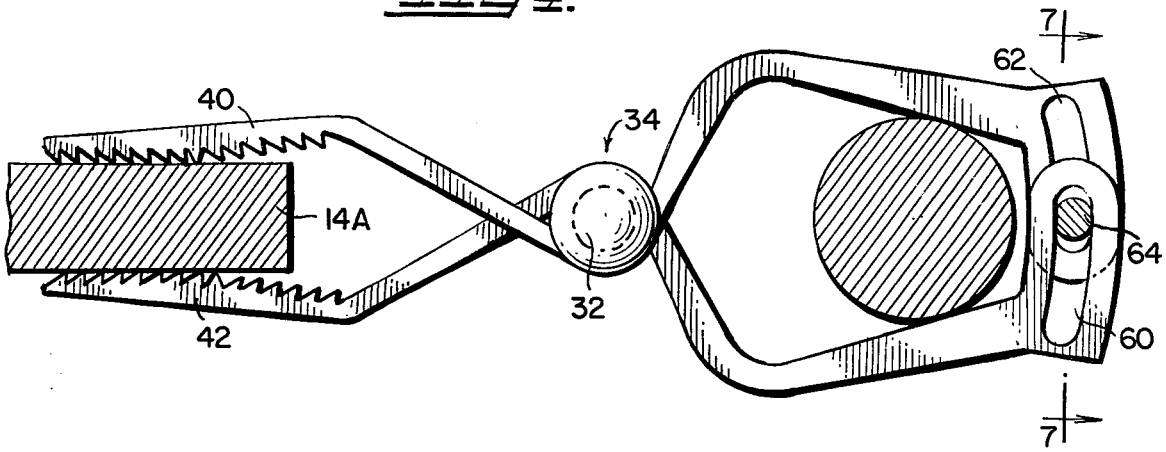
FIG. 4, is a plan view of a grappling member operatively engaged with a load to be moved showing engagement of clamping jaws with the item.

As noted, the clamping jaws have teeth adapted to bite into the leg of a skid or pallet and springs are provided to maintain a sufficient pressure on the jaws to ensure that the attachment will not lose its grip when it is secured but in a static mode before a pulling force is applied. The hinge serves the purpose of pivoting the handles to positions shown in FIGS. 4 and 5 to permit spreading or contracting of the grappling jaws. The opposite end of the attachment includes the actuating pin inserted in and through the space 46 formed between the arms 48 and 50. When a tension load is applied on the rope, the pin 66, coacting with the camming faces 52 and 54, spread these ends as shown in FIG. 4, and by virtue of the handle shape and the pivot or hinging thereof force the grappling jaws toward one another to bitingly engage the skid as shown in FIG. 4. The heavier the load, the greater the tension and the greater the tension, the greater the bite on the leg. There is, thus, a relationship between the energy needed to move the load and the force exerted on the grappling jaws on the skid.

It is noted that the handles nest so as to permit free travel, and the slots control the amount of travel, and accommodate the various widths of skid legs which might be encountered. The slots also permit a bi-directional travel and allow for the operator to manually squeeze the handle ends to open the jaws when attaching the apparatus to a leg of the skid or the like. The pin 64, riding in the slots, insures that the actuating pin 66 is contained within the space under all operating conditions.

It will thus be seen that the present invention is directed to an attachment member including a grapple for engaging base runners of pallets or the like to enable their removal from a cargo vehicle where the usual loading truck is not available, and the load must be pulled to the tailgate of the vehicle or to the access door of the vehicle for easy engagement by the prongs of a forklift truck. The structure and operation of the attachment is such that the handles have a contour whereby a member such as the actuating pin, when inserted between the handles, will increase pressure in direct proportion to the load being engaged and the connecting slots serve the purpose of limiting the extent to which the handles can be contracted or expanded, and further serve as a safety feature to prevent disengagement of the handle actuating member should the handles, for example, bend due to the load exerted thereon.

While only a single, preferred embodiment has been described in detail, manifestly, minor changes in details can be effected without departing from the spirit or scope of the invention as defined in and limited solely by the appended claims.

I claim:

1. An article moving attachment comprising a pair of opposed arms in side by side relationship, hinge means interconnecting said arms intermediate their ends, first portions of said arms on one side of the hinge means initially diverging at an angle from one another, and thence converging at a reversed angle, the free ends of said first portions being in substantial longitudinal alignment and constituting coacting grappling jaws, said arms having second portions, on the opposite side of the hinge means, initially diverging at an angle from one another, thence converging at a reversed angle toward one another, an open space defined between the initially diverging and thence converging, second portions of said arms, an actuating member in said space, the converging second arm portions defining, in said space, converging camming surfaces toward the outer ends thereof and engageable by said actuating member, said member coacting with said camming surfaces to spread the outer ends, of said arms upon longitudinal displacement of said member when a longitudinal force is applied on said actuating member in a direction away from the hinge means, a line operatively connected to the actuating member and adapted to apply force to said member to resultantly move the attachment, and simultaneously said grappling jaws being pivoted toward each other to forcefully engage an article therebetween upon spreading of the outer ends of said arms by movement of said member along said camming surfaces, said outer ends of said arms, beyond said space, being provided with overlapping coacting similarly curvilinear shaped slots, a pin engaged in and between said slots, said slots and said pin coacting with said second arm portions and hinge means to define an end closure for said open space wherein said actuating member is mounted, and to delineate limits of pivoted angular movement in one direction of one said arm with respect to the other said arm by engagement of said pin and ends of said slots, and, by closing the space, restraining said actuating member from displacement therefrom.

2. An article moving attachment as claimed in claim 1, wherein the weight of said article is directly related to a force required to move the article, the greater the required moving force, the greater the force applied to said actuating member and therefore to pivoting movement of said arms, whereby the grappling force is commensurately increased in direct relationship to the article weight and moving force required.

3. An article moving attachment as claimed in claim 1, a Y-shaped connector having spaced legs, and having bored ends on said spaced legs, said actuating member being a pin having its ends inserted in said bored ends, said Y-shaped connector having a base leg having a hole therethrough, an attachment connection member secured to the end of said force applying line, and a hook being selectively insertable through said hole, said line being adapted to have a force applied thereto from a remotely located power means, whereby upon actuation of said power means, said article, through said line and moving attachment, is moved from an initial position to a subsequent position along a supporting surface or the like.

4. An article moving attachment as claimed in claim 3, wherein the article to be moved includes a skid having base runners and a load mounted on the floor of said skid above said base runners, said skid being movable along a support surface upon actuation of said power means.

5. An article moving attachment as claimed in claim 1, and further including spring means mounted on the hinge pin and having legs extending into contact with portions of said arms on said one side of the hinge pin and operable to urge said grappling jaws into coacting grappling position.

6. An article moving attachment as claimed in claim 1, the free ends of said arms constituting coacting grappling jaws including internally directed teeth for pressing engagement into an article to be moved.

7. An article moving attachment as claimed in claim 6, said teeth being arranged substantially along two angularly disposed planes having an apex therebetween substantially at a mid-point of said grappling jaw.

8. An article moving attachment as claimed in claim 1, said hinge means including overlapping central portions of said arms having respectively opposite angular configurations, and conjointly defining therebetween an intermediate open space, a pin hinge disposed in said intermediate open space said arms being pivotal around said pin.

* * * * *